United States Patent [19]

Kocsan

[11] Patent Number: 4,478,204

[45] Date of Patent: Oct. 23, 1984

[54] SYSTEM OF A BOW STABILIZER AND AN EMBEDDED ARROW HEAD REMOVER

[76] Inventor: Joseph A. Kocsan, 10743 Philadelphia Rd., White Marsh, Md. 21162

[21] Appl. No.: 462,226

[22] Filed: Jan. 31, 1983

[51] Int. Cl.[3] ..... F41B 5/00

[52] U.S. Cl. ..... 124/89; 273/416; 29/254

[58] Field of Search ..... 124/23 R, 24 R, 89, 124/86; 273/416, 419, 421; 29/254, 275

[56] References Cited

U.S. PATENT DOCUMENTS

| | | | |
|---|---|---|---|
| 3,529,497 | 9/1970 | Brooks | 29/254 X |
| 4,043,020 | 8/1977 | Hoggard | 29/254 X |
| 4,125,927 | 11/1978 | Geary | 29/254 |
| 4,150,469 | 4/1979 | Hoggard | 29/254 |
| 4,169,454 | 10/1979 | Jones | 124/23 R |

FOREIGN PATENT DOCUMENTS

| | | | |
|---|---|---|---|
| 2538490 | 3/1977 | Fed. Rep. of Germany | 124/89 |

*Primary Examiner*—Richard J. Apley
*Assistant Examiner*—William R. Browne
*Attorney, Agent, or Firm*—John F. McClellan, Sr.

[57] ABSTRACT

A bow-and-arrow accessory of the type stabilizing a bow when attached thereto has a detachable portion for removal of embedded arrow points, that includes a straight rod with a set-screw equipped weight. The weight is slidable on the straight rod for adjustably varying the moment arm of the weight when the rod is attached to a bow. The weight is also slidable as a hammer against an anvil on a first end of the rod for axially with-drawing an embedded arrow point when the second end of the rod is attached to an embedded arrow point. The hammer action results in axial withdrawal and so eliminates dangers of damaging arrow points by wrenching, rocking or prying, and lowers risk of slipping and straining injury to the person removing an embedded arrow point.

5 Claims, 8 Drawing Figures

SYSTEM OF A BOW STABILIZER AND AN EMBEDDED ARROW HEAD REMOVER

FIELD OF THE INVENTION

This invention relates generally to archery and specifically to a bow accessory.

BACKGROUND OF THE INVENTION

A frequent problem in archery is that arrows embed in targets and cannot be removed without injury of the arrow or to the target.

For example, detachable arrowheads used in practice (so-called "Converta-point" type) embed in tree trunks and usually are left there, the user simply unscrews the arrow shaft from the point and walks away.

This is expensive and in the long run because of the cost of practice points, and requires buying and carrying a number of extra points in excess of what otherwise is needed as spares.

PRIOR ART

In the prior art, U.S. Pat. No. 4,169,454 issued to L. M. Jones on 10-2-79 disclosed a combination bow-stabilizer and arrowhead remover. This included an elongate member with threaded connection for attachment to a bow and bow-stabilizing weight detachably mounted on the end. A cross-bore in the weight permits "rocking and twisting" arrowheads free after the elongate member is screwed into them. It will be evident that "rocking and twisting" can damage the arrowhead and can further damage the tree or other target.

West German Pat. No. 2,538,490, Aug. 29, 1975; Mar. 3, 1977, showed a stabilizer with an elongate member attached to a bow in the portion of a stabilizer, a weight on the end of the elongate member, and a slider between the weight and the bow. A spring provision was associated with the slider on the elongate member.

SUMMARY OF THE INVENTION

A principal object of this invention is to provide a combination bow stabilizer and arrow point retriever system that is optimum and requires no other tools to use.

Further objects are to provide a system as described which salvages arrow points in undistorted, re-usable form by pulling them straight back along the path they travelled on entering a tree or other object, which safely taps them out of the object and so avoids strain and slippage on the part of the user, and which employs the same sliding weight used in tapping in an adjustment for the stabilizer function.

Yet further objects are to provide a system as described which is economical to produce, easy to use, and attractive in appearance.

DETAILED DESCRIPTION

Figure 1:
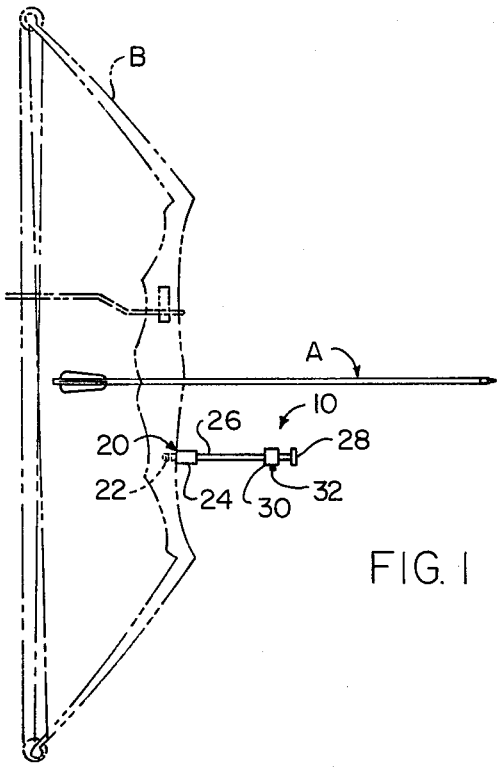
FIG. 1 is a side elevational diagram showing relation of bow with the invention mounted on it, and arrow.

FIG. 1 shows the invention installed as an adjustable stabilizer 10 on a typical bow B for stabilizing the bow when shooting an arrow A.

The adjustable stabilizer 10 comprises only a few elements:

(1) a mounting adapter 20 which has a male threaded portion 22 screwed into the front of the bow, supporting a threaded socket portion 24;

(2) a shank including a rod 26 which at the first end screws into the mounting adapter 20 socket portion 22 and which at the second end terminates in an integral enlarged end or anvil 28; this anvil portion may be threaded on the rod and held with a set-screw as will be described later, or may be integral;

(3) slider weight or sliding weight 30 which slidably fits on the shank rod; and (4) adjustment screw 32 which passes radially through the wall of the slider weight and when tightened bears on the rod 26, fixing the slider weight in adjusted position along the rod at any position desired for stabilizing the bow B. That is, sliding the weight along the rod varies the moment-arm of the weight relative to the bow, and the slidable position can be fixed by the screw in the weight.

Figure 2:
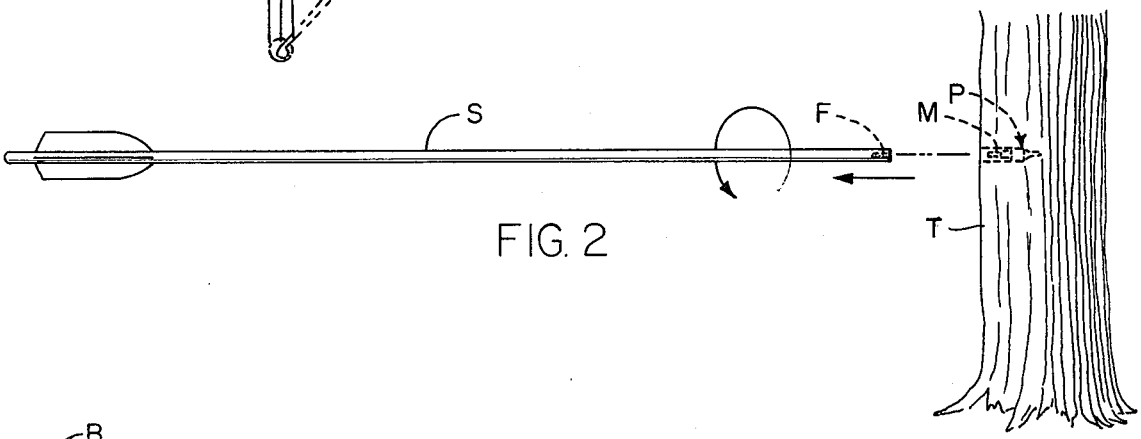
FIG. 2 is a side elevational diagram showing the first step in retrieving an arrow point embedded in a tree.

FIG. 2 shows the first step in retrieving an arrow point P embedded in a tree T, namely unscrewing the arrow shaft S from the point. Typically, male threads M on the rearward part of the arrow point are coupled to female threads F in the forward end of the shaft, and unscrewing this junction takes only a few seconds.

Figure 3:
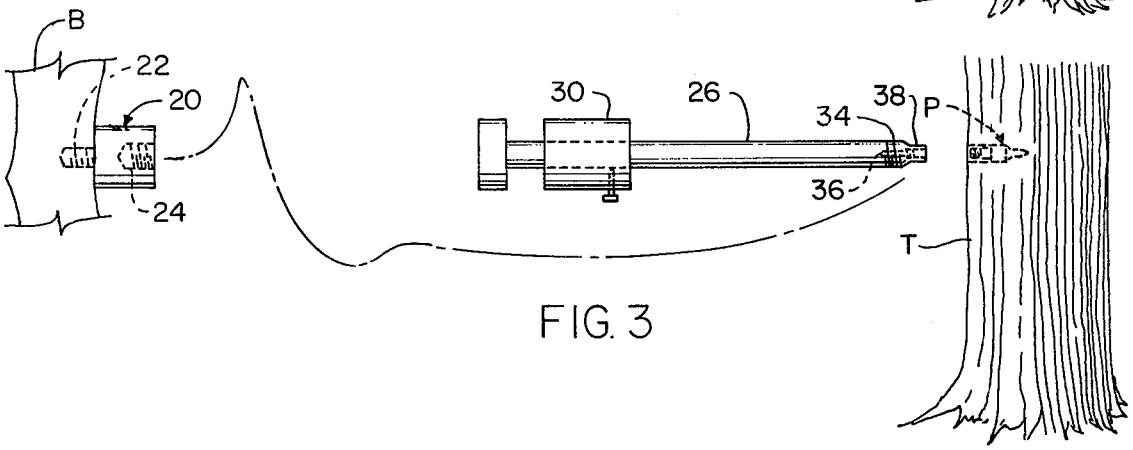
FIG. 3 similarly diagrams a second step.

FIG. 3 shows the next step in the system, unscrewing the stabilizer rod 26 carrying the slider weight 30, from the mounting adapter 20, which remains screwed to the bow B by threads 22.

The mounting adapter 20 has in the front end the co-axial threaded socket 24; into this socket the rod 26 mounts by means of male threads 34 on the rod end (this threaded connection is the one unscrewed to separate the rod 26 with slider weight 30 on it from the bow B). Internal screw threads 36 in the tubular reduced-end 38 of the rod will serve to screw it to the arrow point in the next step.

Figure 4:
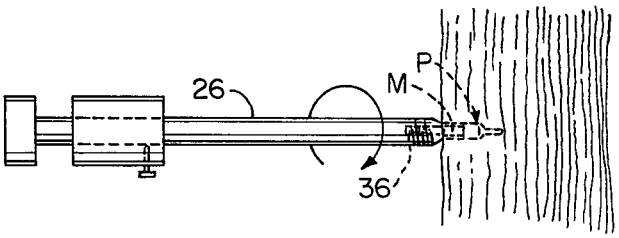
FIG. 4 similarly diagrams a third step.

FIG. 4 shows the next step, screwing the internal threads 36 in the end of the rod 26 onto the arrow point threaded rear end M.

Figure 5:
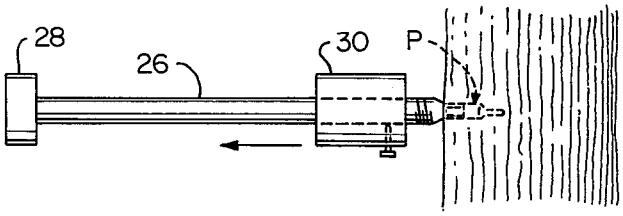
FIG. 5 similarly diagrams a fourth step.
Figure 6:
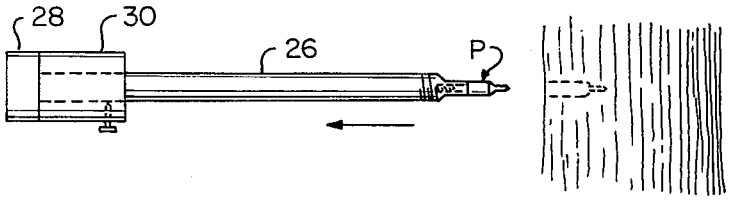
FIG. 6 similarly diagrams a fifth step.

FIGS. 5 and 6 show the succeeding two steps in which the sliding weight 30 is slid straight back along the rod 26 to hammer against the anvil 28, drawing the point P straight back along the path it made on entering the tree. This eliminates two undesirable factors in arrow point removal:

(1) distortion of the point from wrenching, rocking or prying;

(2) strain and danger of slipping while pulling on an arrow shaft or any arrow point retriever while recovering arrow points.

With the arrow point P recovered from the tree or other object, it may be then unscrewed from the rod 26 and screwed onto an arrow shaft for re-use in the normal manner.

Figure 7:
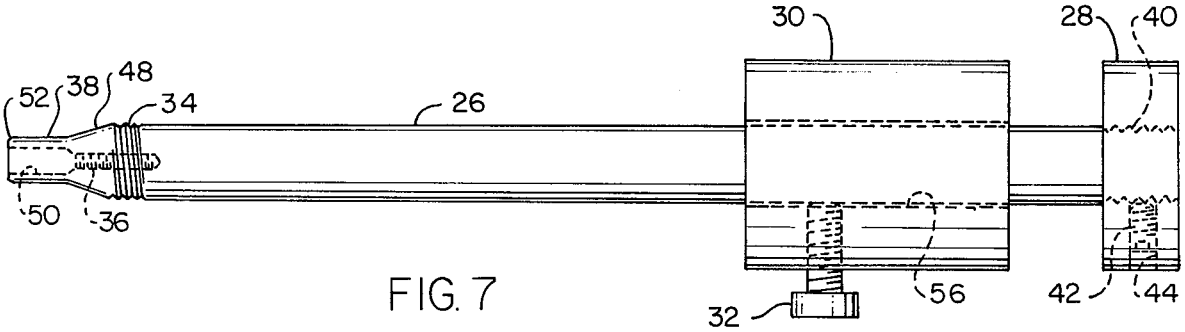
FIG. 7 is a side elevational view on an enlarged scale of a portion of the invention.

FIG. 7 shows details of the system in enlarged view. Rod 26 may mount the anvil 28 by means of coaxial threaded connection 40 between them. A set screw 42 in a threaded hole 44 passing through the anvil end and bearing on the rod 26 may be used for further security, if desired. Anvil size may be $1\frac{3}{8}$ inch (3.4 cm) in diameter by $\frac{1}{2}$ inch (13 mm) long, or any suitable size.

Slider weight 30 may be of any suitable size; for example $1\frac{3}{4}$ inches (4.3 cm) long and $1\frac{3}{8}$ inches (3.4 cm) in diameter. The adjustment screw 32 in it may have a flat end 44 as shown for bearing on the rod 26 without scarring. 56 is the hole for rod 26.

The rod 26 may be $\frac{1}{2}$ inch (13 mm) in diameter and 8 inches (21 cm) long, or of any other suitable size.

External threads 34 on the rod 26 may be $\frac{1}{2}$–20 threads. Coaxial, reduced portion 38 on the rod may be 5/16 inch (8 mm) in diameter by $\frac{3}{8}$ inch (9 mm) long or any other suitable size, preferably smaller in diameter than an arrow shaft for easiest access to embedded arrow points. The transition 48 between the full diameter rod portion and reduced diameter terminal rod portion may have a conical shape.

Internal threads 36 in the tubular end of the rod may be 8–32 threads to fit standard arrow points ("Convertapoints"). The coaxial counterbore 50 in the end of the reduced-diameter terminal portion of the rod may be $\frac{3}{8}$ inch (9 mm) long by 3/16 inch (4.7 mm) in diameter to make a snug fit with the similar area of a standard arrow point, and the exterior of the end may have a 45° bevel 52.

Figure 8:
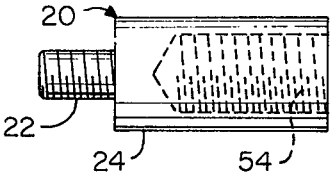
FIG. 8 is a similar side elevational view of another portion of the invention.

FIG. 8 shows details of the mounting adapter 20. Male threaded portion 22 for screwing into the bow may be $\frac{1}{2}$ inch (13 mm) long and may have 5/16–24 threads. The coaxially opposed socket 24 may be $1\frac{3}{8}$ inch (3.4 cm) long and may have $\frac{1}{2}$–20 threads at 54. Outside diameter of the socket portion may be $\frac{3}{4}$ inch (18 mm).

The invention may be made of steel, preferably stainless or plated, or may be of brass or other suitable metal.

The dimensions and materials given are by way of example only and do not limit the principle of the invention.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be secued by United States Letters Patent is:

1. In a system for stablizing a bow and for withdrawing embedded arrow points of the type having screw threads for attachment to arrow shafts, said system including a rod, a bow stabilization weight on the rod with the rod providing a moment arm for the weight when the weight is mounted to a bow, means for mounting the rod to a bow, and internal screw threads at a first end of the rod for attaching the rod to screw threads of an arrow point; the improvement comprising: said rod having an anvil portion at a second end of the rod, said weight being slidable in position on the rod between the means for mounting and the anvil portion for varying the moment arm of said weight when the rod is mounted on a bow, and said weight being slidable on the rod for hammering on said anvil portion for withdrawing an embedded arrow point when the rod is attached to an embedded arrow point by said screw threads.

2. In a system as recited in claim 1, means for adjustably fixing the position of said weight on the rod.

3. In a system as recited in claim 2, said means for adjustably fixing comprising a screw through a portion of said weight.

4. In a system as recited in claim 1, said means for mounting including a male threaded portion for screwing to a bow and a threaded socket integral with said male threaded portion.

5. In a system as recited in claim 4, said rod first end having: screw threads for engaging said threaded socket, and a reduced-diameter terminal portion containing said internal screwthreads and a coaxial counterbore sized for engaging a portion of an arrow point.

* * * * *